US011384479B2

(12) United States Patent
Cendales Miguez

(10) Patent No.: US 11,384,479 B2
(45) Date of Patent: Jul. 12, 2022

(54) METHOD FOR IMPROVING THE SHARPNESS AND STABILITY OF PRINTED TEXTILE FABRICS

(71) Applicant: Grupo Textil Providencia, S.A. de C.V., Tlaxcala (MX)

(72) Inventor: Rafael Enrique Cendales Miguez, Tlaxcala (MX)

(73) Assignee: Grupo Textil Providencia, S.A. de C.V., Tlaxcala (MX)

( * ) Notice: Subject to any disclaimer, the term of this patent is extended or adjusted under 35 U.S.C. 154(b) by 229 days.

(21) Appl. No.: 16/815,065

(22) Filed: Mar. 11, 2020

(65) Prior Publication Data

US 2020/0291572 A1 Sep. 17, 2020

(51) Int. Cl.

| | |
|---|---|
| ***D06P 5/30*** | (2006.01) |
| ***D06P 7/00*** | (2006.01) |
| ***D06P 5/00*** | (2006.01) |
| *B41J 3/407* | (2006.01) |
| *B41M 5/00* | (2006.01) |

(52) U.S. Cl.

CPC ..... *D06P 5/30* (2013.01); *D06P 5/00* (2013.01); *D06P 7/00* (2013.01); *B41J 3/4078* (2013.01); *B41M 5/0011* (2013.01); *B41M 5/0064* (2013.01)

(58) Field of Classification Search

CPC ..... D06P 5/30; D06P 5/00; D06P 7/00; D06P 7/005; B41J 3/4078; B41M 5/0011; B41M 5/0064; B41M 5/0047; D06B 1/00; D06B 11/0056

See application file for complete search history.

(56) References Cited

U.S. PATENT DOCUMENTS

| | | | | |
|---|---|---|---|---|
| 4,042,453 | A * | 8/1977 | Conway | D21F 11/006 162/146 |
| 4,812,357 | A | 3/1989 | O'Rell et al. | |
| 5,364,683 | A | 11/1994 | Flint et al. | |
| 5,651,316 | A | 7/1997 | Demoore | |
| 6,770,581 | B1 * | 8/2004 | DeMott | D06N 7/0065 428/96 |
| 10,309,054 | B1 * | 6/2019 | Guo | B41J 3/4078 |
| 2011/0032319 | A1 * | 2/2011 | Kaplan | C09D 11/30 347/101 |
| 2015/0217553 | A1 | 8/2015 | Bowser | |
| 2016/0250863 | A1 * | 9/2016 | Livingston | B41J 13/24 347/110 |
| 2022/0041883 | A1 * | 2/2022 | Guo | D06P 5/30 |

FOREIGN PATENT DOCUMENTS

| | | |
|---|---|---|
| MX | 2013012016 | 4/2015 |
| MX | 2013012017 | 4/2015 |

* cited by examiner

*Primary Examiner* — David H Banh
(74) *Attorney, Agent, or Firm* — Defillo & Associates, Inc.; Evelyn A. Defillo

(57) ABSTRACT

The present invention refers to a method for improving the sharpness and stability of prints by digital printing on hair fabrics and a textile product obtained by the method, which is aimed at solving the problem of capturing a predetermined digital image on a fabric of hair, where the image has characteristics of definition, contrast and durability of the print without neglecting or affecting the texture and joints of the tissue on which it is shaped. Preferably without intending to limit the scope of the invention, the woven material can be bedding such as blankets, quilts and the like, clothing, woven items for personal use, among others made of hair fabrics.

11 Claims, 3 Drawing Sheets

METHOD FOR IMPROVING THE SHARPNESS AND STABILITY OF PRINTED TEXTILE FABRICS

TECHNICAL FIELD

The present invention belongs to the technical field of textile engineering, specifically to the industrial processes of production, treatment and printing processes of textile fibers where there is a series of processes where the fabric is prepared for the reception of one or more prints of ink for obtaining a plastered image and even more specifically, the present invention refers to a method for improving the sharpness and stability of prints by digital printing on hair fabrics and a textile product obtained by said process.

BACKGROUND

The desire to add color and design to textile materials is almost as old as humanity. The first civilizations used color and design to distinguish themselves and separate themselves from others. Textile printing is the most important and versatile of the techniques used to add design, color and specialty to fabrics. It can be considered as a technique that combines art, engineering and dyeing technology to produce images that only existed in the imagination of the textile designer. In ancient times, man used these designs and images primarily for fabrics to wear, but in today's market, textile printing is very important for upholstery fabrics, home (sheets, towels, curtains), rugs, carpets and other uses. Since then, printing techniques have evolved on textile fabrics, from handicraft work to the implementation and development of machinery. However, having changes in all related aspects in this field of textile engineering, experts have been forced to address various difficulties that come in addition, for example, it is intended that the print has a better sharpness and clarity in the image, which lasts over time, but at the same time the characteristics of the fabrics are not lost, which has meant a real challenge.

Traditional techniques employ the printing of textile fabrics in frames, which is widely known in the state of the art, where there is a frame or frame with a predetermined image that is veiled, in which a plurality of colors result of combinations of black, yellow, magenta and cyan. However, this technique has marked and known disadvantages, such as, for example, the cost of developing positives and printing frames are high, making it impossible to produce few production pieces. The print quality is inferior since the details are lost; it does not achieve the sharpness that is expected. The techniques are limited to the number of frames covered by the printing machine. During the manufacturing process, a lot of water, dyes and reagents are used, it is not easily scalable to print more fabric surface, among others that put this printing methodology at a disadvantage, and motivates experts to look for new and better printing methods on textile fabrics The traditional stamping process, called flat screen printing or rotary screen printing, needs a previous color separation process, this process makes the design color be divided into several frames or cylinders. When this color separation is stopped, images are obtained in gray scales, to be able to represent it in a cylinder it is necessary to use frames of points that are more open or closed according to the intensity of color that is required, this same detail limits to a maximum resolution printable in sight, being noticeable in weight, which gives a feeling of low resolution.

Previously, the processes to obtain fabrics are handcrafted and because of their configuration they lacked a scalability that allows a large production to meet the needs demanded by the market, so the textile industry has focused efforts on a series of oriented technologies to solve the problem of tissue production where these processes have a series of steps that somehow makes them scalable, these processes, however, lack the optimum final quality to be considered in a range acceptable by the user and the needs that the industry has today.

Recently, new printing techniques and systems have emerged that have been developed, have been able to generate visually more attractive textile products; The costs for this concept mean that these technologies are not applied or are limited in their use in this productive branch.

The need to print large areas of textile fabrics, such as covers, means that new methods are sought, however, in many cases it is economically unfeasible due to the high costs involved in the various printing systems, so conventional printing processes are used that do not achieve the objectives, nor the needs in terms of quality of images obtained in the final products.

Proposals have been made to print such products from files of electronic origin that can be processed directly in the printing press or inkjet printing system. These processes have been tried with modest success on surfaces such as vinyl, but successful printing on textile surfaces has been even more limited.

In this sense, some state-of-the-art documents describe some technologies aimed at providing a solution to digital printing on textiles, such is the case of U.S. Pat. No. 4,812,357 (A) where reference is made to a blanket of printing that has a printing blanket with properties of dimensional stability, compressibility and web advance comprising a housing, a compressible layer covering the housing, a stabilizing layer of reinforced thermoplastic elastomer covering the compressible layer and a surface layer of rubber impression without gaps where it also has a thermoplastic reinforced elastomer that is formed by thermoplastic fibers or fibrils dispersed throughout the elastomer. Preferably, the thermoplastic melts when mixed with the elastomer to provide very fine and well dispersed fibrils.

In the same sense, a printing blanket and its method of preparation is described in the U.S. Pat. No. 5,364,683 (A) where it is laminated of multiple layers for use in offset printing that comprises in order a first layer of fabric compressible, a compressible elastomer layer, at least two additional fabric layers located on the compressible elastomer layer, an elastomer sublevel and an elastomer print face deposited by a solvent-free process and with a surface profile adapted to reduce the gain of points while improving the ability to release printed matter. At least the lower fabric layer incorporates a protective coating to prevent the absorption of inks, water and/or solvents through the blanket, which could otherwise cause swelling and lamination of the different layers. In addition, both the fabric layers and the compressible layer are at least partially coated with a matrix material having a plurality of closed cells formed therein, for example, with the use of blowing agents or by adding a plurality of micro expanded or expanded spheres.

In the same direction are printing units with retractable coating operable in the plate and blanket cylinders as in U.S. Pat. No. 5,651,316 (A) where prints are simultaneously made from the side of the damper of the first printing unit where a retractable inking apparatus with in-line coating can apply punctual or general inking coating material to a plate and/or a blanket in the first printing unit or in any consecutive printing unit of any rotary offset printing press. The coated inking apparatus is pivotally mounted within the conventional buffer space of any lithographic printing unit. The aqueous component of the flexographic printing ink or the aqueous coating material is evaporated and dried by high speed hot air dryers and high performance moisture and heat extractors, so that the aqueous or flexographic ink or the material of Coating on a freshly printed or coated sheet is dry and can be trapped dry in the next printing unit. The inking/coating apparatus includes double cradles that support the first and second applicator rollers, so that the inking/inking apparatus can apply a double stroke of UV/flexographic or UV curable printing ink or coating material to a plate on the plate cylinder, while at the same time applying aqueous, flexographic or UV curable printing ink or coating material to a plate or blanket on the blanket cylinder, and then onto a sheet as the sheet is transferred through the contact line between the blanket cylinder and the printing cylinder. A triple protrusion is printed or coated on the last printing unit with the aid of an inking/coating unit of the printing cylinder.

An on-demand printing method for creating the top layer of a quilt or the like is widely described in application US 20150217553 (A), which uses a computer, a software program to create a desired design that is printed directly on several sheets. of cloth. The sheets are formulated to preserve the printed design and have a rigid lining to facilitate printing by using a standard desktop printer for the consumer. The sheets are strategically positioned, joined and trimmed to form the top layer of the desired quilt.

Notwithstanding the foregoing, those of us who are involved in this technical field have been forced to perfect our own techniques, such is the case of patent applications MX 2013012016 (A) and MX 2013012017 (A) of the same authorship and considered as the documents closer to the present invention, in which a system and method of printing images in high resolution on textile material, preferably bedding such as sheets and pillowcases, using an improved sublimation technique, where it is generated, is described an arrangement of the color profiles in printers in terms of pre-sublimation printing and in the sublimation process to be able to choose economic inks and transfer paper of better quality and pressure that offer excellent sublimation results and where the equipment that allows perfecting the sublimed consists of a calender with heat emitting cylinder heated by recirculation of hot oil to generate high, constant and uniform temperatures over the entire surface of the cylinder; So the combination of this innovation plus the use of high temperatures, allows a better transfer of solid-state to gaseous ink, as well as getting brighter colors that in turn highlight the quality of the images, achieving in the Textile material HD images 720 dpi up to 1440 dpi.

Notwithstanding the foregoing, even though these documents express the possibility of making a digital print on hair fabrics, the limitation of printing on tall hair is clearly evidenced, because the results were not as expected, because the textile product stamped specifically on hair fabrics does not retain the desired clarity and sharpness, this due to the lack of color penetration on the hairs of the fabric, among other aspects that do not allow to appreciate the same color tone on the fabric when observed in the four cardinal points, in addition to observing from a higher perspective, white points or spaces are appreciated where the color does not penetrate, which leads to obtaining a textile product that does not meet the demands that the market demands.

OBJECT OF THE INVENTION

Therefore, a main object of protection refers to a method to improve the sharpness and stability of prints by digital printing on textile fabrics specifically for hair.

Another object of the invention is aimed at providing a method for improving the sharpness and stability of prints by digital printing on textile fabrics specifically for hair, with high definition image printing without loss of detail.

Another objective of the invention is to allow the method to give the hair fabric an impression of high definition images, which also allows to achieve optimum sharpness in the printed images, achieving better color, definition and innumerable custom designs, with realism as if a high quality photograph was being stamped, in addition to such soft and comfortable hair fabrics.

Another object of the invention is aimed at providing a method for improving the sharpness and stability of prints by digital printing on hair fabrics, which also allows significantly reducing printing costs at industrial production levels.

The objectives of the present invention referred to above and still others not mentioned, will be evident from the description of the invention and the figures that accompany it by way of illustration and not limitation, which are presented below.

Another object of the invention is aimed at providing a method for improving the stability of digital printing patterns on textile fabrics specifically of hair by penetrating the ink into the fiber, which allows it to remain on the fabric, being able to wash it. without fade or discolor.

Still another object of the present invention, refers to a system to improve the sharpness and stability of prints by digital printing on hair fabrics.

Another object of the invention relates to a textile product obtained according to the method of the invention made with a digitally printed hair fabric, wherein said hair has greater color penetration in its fibers and an increase in its circumference.

DESCRIPTION OF THE INVENTION

Figure 1:
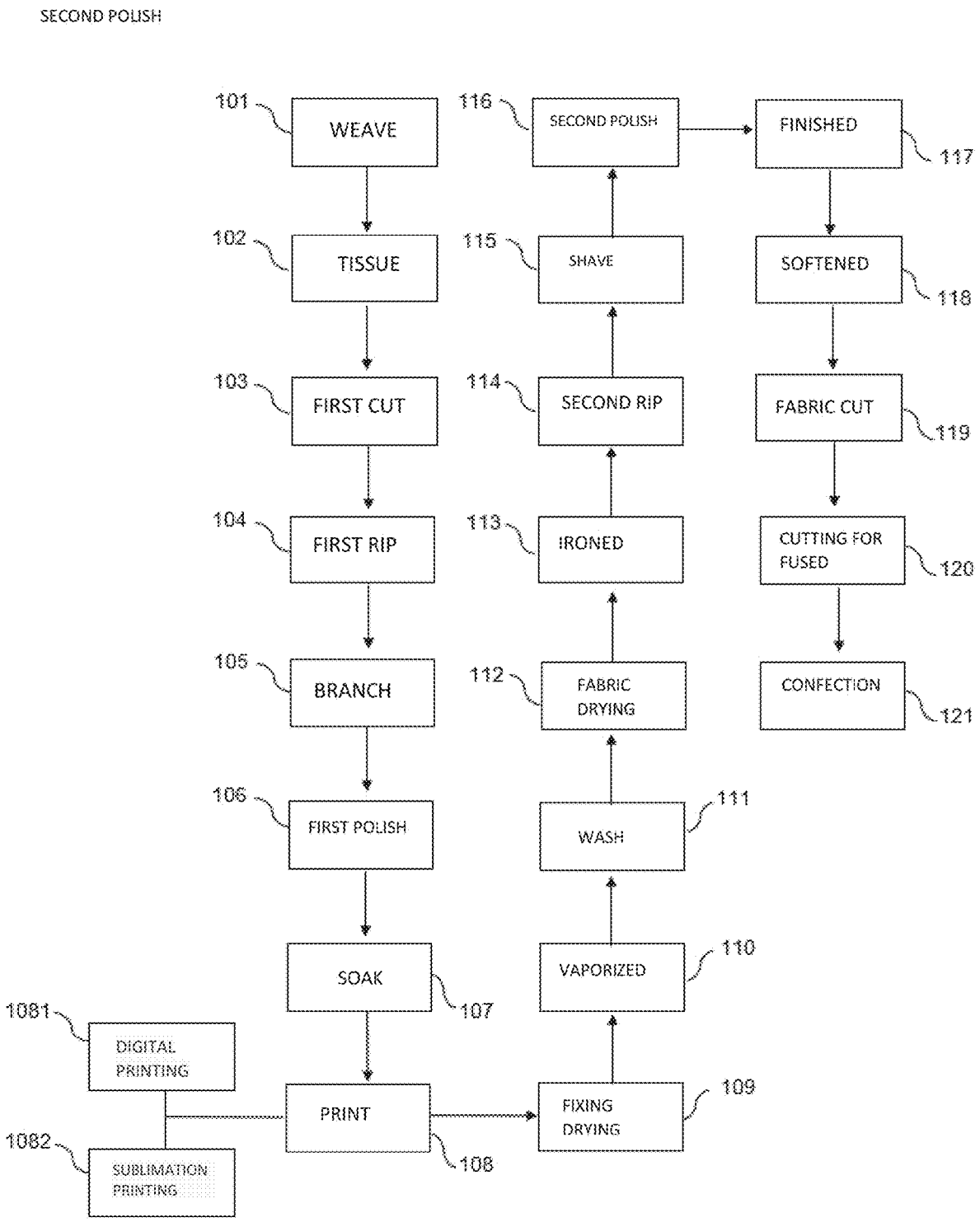
FIG. 1 shows a flow chart of the method of the invention for making a quilt.

The present invention refers to a pattern on a woven material, particularly the hair fabric and the method of manufacturing it, which is aimed at solving the technical problem of capturing a predetermined digital image in a hair fabric, wherein said Image presents characteristics of definition, contrast and durability of the print without neglecting or affecting the texture and joints of the tissue on which it is shaped. Preferably without intending to limit the scope of the invention, the woven material can be bedding such as blankets, quilts and the like, clothing, woven items for personal use, among others made of hair fabrics.

The method object of protection influences the effectiveness of penetrating the color and the uniformity of the tones of the prints seen from the four cardinal points, particularly in the height of the hair of the fabric, being able to offer these qualities in hair with height from 0.5 mm to 25 mm The invention also contemplates hair textile products obtained with the method to improve the sharpness and stability of prints by digital printing, which allows several images or design elements in different legs of the hair fabric, visually improving them; highlighting that so far there are no products with these characteristics on the market. Being able to generate designs with a central image of different colors that corresponds to the surface of, for example, a mattress and a perimeter pattern that falls to the sides of the mattress without seams and with the same or different colors; designs that include an image on the entire surface, designs that include a header with images and the rest of the surface with a pattern of ornate figures or patterns; designs with an engraving in the upper area and valance as you carry texts, graphics and engravings in the same or different color.

The textile fabric can be made of at least one of natural fibers, such as wool, cotton, silk, miraguan, linen, hemp, jute, abaca, esparto, coconut, broom, ramie, sisal, sunn, henequen, maguey. It can also be manufactured from at least one of artificial and synthetic fabrics, selected from acetate, alginate, cupro, modal, protein, triacetate, viscose, acrylic, chlorofiber, fluorofiber, modacrylic, polyamide or nylon, aramid, polyimide, lyocell, polylactide, polyester, polyethylene, polypropylene, polycarbamide, polyurethane, vinyl, trivinyl, elastodiene, elastane, fiberglass, elastomultyester, elastolefin, melamine, or a combination of natural and synthetic fibers.

The method to improve the sharpness and stability of prints by digital printing on hair fabrics is comprised of the following stages:

Polish a hair fabric by passing it through a heat transfer device, at a temperature between 150 and 180° C. at a speed that allows an exposure time of between 10 and 26 m/min, preferably 15 m/min;

Make a print of a digitized image, preferably by digital printing on the hair fabric;

Pass the hair tissue through a drying chamber comprising the arrangement of cooling and fluid dispersion means, preferably fans configured to work between 500 to 800 rpm and heat emission means configured to reach temperatures between 120 to 160° C., preferably at 155° C., where the fabric passes at a speed of between 4 to 25 m/min;

Apply hot steam to the hair fabric within an airtight space at a temperature of at least 100° C., preferably at 110° C. for at least 5 min to heat set the colors;

Wash to remove excess color from hair tissue;

Dry the hair tissue;

Stretch the hair tissue to eliminate wrinkles;

Perform a rip to confer terry characteristics to the tissue by obtaining hair;

Shave the hair in order to match the height of the hair to the same length, or remove the remaining fiber;

To polish the hair fabric for the second time by passing it through a heat transfer device, at a temperature between 100 and 190° C. at a speed that allows an exposure time of between 5 and 20 m/min;

Dry the hair tissue by branch to heat set and avoid shrinkage and deformation;

Apply a stream of hot air under pressure at a temperature of at least 180° C. at a speed of at least 2 m/min on the surface of the hair fabric to increase the diameter or volume of the hairs present.

Referring to FIG. 1, there is contemplated a modality of a method for manufacturing a quilt with improved sharpness and stability characteristics of digital printing patterns, which comprises the following steps:

Warped (101)

First, there is a well-known stage for a technician in the field of textile engineering. In the warp a warp is rolled up on a folder, where it has at least one pair of bobbins, to this warp is placed a plurality of preferably polyester threads ordered and folded in orthogonal arrangement that have a length of at minus 1 m, and a diameter of at least 50 cm.

Fabric (102)

In a first embodiment, a series of interlocking of at least one pair of threads consisting of the longitudinal serial connection of a warp with another obtained from the warping stage (101), which has a length of at least 1 m. In a considered embodiment, the fabric can also be made of a plurality of ties that interweave to form a mesh that has a length of at least 1 m.

First Cut (103)

Subsequently, there is a stage of a first cut, where the previously manufactured fabric is sectioned which meets the size of the fabric to be used in later stages.

First Rip (104)

Once sectioned in the first cutting stage, each of the process fabrics is incorporated into a first rip stage, where through a plurality of blades incorporated in a cylinder arranged at least 1.5 mm apart scrape or they tear the fabric and by means of the circular movement of said cylinders at a depth of at least 1 mm with respect to the face of the fabric where these blades are arranged against each other having to be given the fabric plush characteristics by obtaining hair by means of the tearing caused by the blades.

Branch (105)

Subsequently there is a branch process where thermofix and gives measure to the fabric.

First Polish (106)

During the development of the present invention it was found that when performing a polishing step prior to printing, better results of clarity of the prints were obtained. For this case, it was necessary to determine the specific conditions that could give the desired result, since if this stage is not carried out with the appropriate parameters the results confer undesirable characteristics on the color. The first polishing consists in passing the hair tissue through a heat transmission device, preferably by convection at a temperature between 150 and 180 degrees Celsius at a speed that allows an exposure time of between 10 and 26 m/min, preferably 15 m/min, which allows the fabric to acquire a constant gloss finish in case it should be stored.

Soak (107)

The soaking stage is optional and consists of moistening the fabric with some penetrating agent, although the water can serve, this allows the colors to be absorbed and cover a greater surface when stamping e of the hairs of the fabric and consequently a greater impregnation is obtained.

Stamping (108)

For the stamping stages, the possibility of carrying it out in any of the following steps is preferably more non-limiting:

A first embodiment includes a digital printing process, where the fabric is subjected to a digital printing process (1081) through a series of digital printing machine that allows the implementation of a large number of images, using combinations of colors such as black, yellow, magenta and cyan.

In a second embodiment, there is a sublimated printing process (1082), where firstly a printing on bond and extra-cellulose paper of 18 to 85 grams is preferably available in dimensions coinciding with those of the fabric being treated, where through a calender that inside has oil at a temperature between 205 and 215° C. and turning at a speed that allows an exposure time of 3.4 m/min transfers the heat present in the oil and captures the image on the tissue.

Even more desired, the printing can be by digital sublimation, for which there is a system and printing of images in high resolution on woven material that uses the technique of sublimation perfection as described in Mexican MX applications 2013012016 (A) and MX 2013012017 (A).

Fixing Drying (109)

Fixing drying includes subjecting the hair tissue to a drying chamber comprising the arrangement of cooling and fluid dispersion means, preferably fans configured to work between 500 to 800 rpm and heat emission means configured to reach temperatures of between 120 to 160° C., preferably at 155° C., where the fabric passes at a speed that allows an exposure time of between 4 to 25 m/min. Preferably, the fluid cooling and dispersion means and the heat emission means are configured to regulate the temperature in a drying chamber, such that said step can be done by gradually regulating the temperature for better results. in fixing different colors that can change their hue under different conditions.

Steamed (110)

This stage consists of placing the fabric in an airtight space and entering hot steam with a temperature of at least 100° C., preferably at 110° C. for at least 5 min to heat set the colors.

Wash (111)

After the vaporization stage, a washing stage is available, in which the hair tissue is subjected to a wash to remove excess color or residual material that may be present in the printing stage; During the washing step a formulation consisting of a reducing agent, preferably thiourea dioxide, caustic soda and a detergent, mixed with water in the following proportions, 5% thiourea dioxide, Caustic soda 5% detergent 15% and 75% water is used wherein said mixture is applied at a temperature of at least 80 degrees Celsius and in this way the excess color is removed without affecting the fabric.

Drying Cloth (112)

The drying stage only has the purpose of drying the hair tissue, for which a method widely used in the state of the art is foreseen, the use of an electric boiler, where it transmits heat at a temperature between 120 and 140° C. when the hair tissue is passed through its structure where it travels inside at a speed of 13 m/min which allows it to eliminate the moisture present in its fibers.

Branch (113)

The branch process includes stretching the hair fabric by at least 5% more than the fabric size by applying heat at a temperature between 175 and 190° C. to eliminate wrinkles that are generated in the previous stages of washing and drying, if these wrinkles reach the perching process, where the wrinkle is found, hair cannot be removed. This stage homologates the height and compaction of the tissues.

Second Rip (114)

In the second rip process the hair fabric is subjected to a tearing passage through a plurality of blades incorporated in a cylinder or drum where said blades have a separation of at least 1.5 mm and have the property of scraping/tear the fabric in an area close to its upper/lower surface by circular movement of said cylinders at a depth of at least 1 mm from the face of the hair fabric, where these blades are arranged against each other having to be conferred to the fabric characteristics of plush by obtaining hair by means of tearing from the intervention of blades in the hair tissue. In this second rip stage, the rip is applied on the reverse of the hair fabric, that is to say on the opposite side of where the stamping was made, and a second step from the opposite side to the first tear and a third tear again from the first face.

Shaved (115)

In the shaving stage, there are a plurality of blades that reduce the length of the hair generated in the second perching process, where the shaving is applied in one pass in the reverse part, that is to say in the face of the hair fabric opposite of the face where the stamping has been performed, and a cutting pass through the opposite face on the face where the stamping has been performed, this in order to match the height of the hair to the same length, or eliminate the remaining fiber.

Second Polished (116)

Once the fabric has received the shaving treatment, it has to be subjected to a polishing step where it is subjected to a temperature of between 100 and 190° C. for a time of at least 1 min at a speed of between 5 and 20 meters per minute, time in which the printing of the image of the fabric has an appreciation of greater brightness in addition to highlighting the colors more, appreciating in a greater way the differences between shades, differentiation of backgrounds in the captured image.

Branch Finished (117)

Subsequently there is a finished branch process where the thermofixation of the fabric is finished to the extent required in cutting to avoid shrinkage and deformation, with this step the dimensional stability is ensured.

Smoothing (118)

In order to raise the level of softness of the fabric and the clarity of the prints when viewed from various cardinal points, it was found advantageously that when applying a stream of hot air under pressure of at least 180° C. by minus 2 m/min on the surface of the fabric it is possible to increase the diameter or volume of the hairs present in the fabric, which were previously subjected to stages that allowed them a greater fixation of color and bright, resulting in a high-hair fabric (without limiting it to short-haired fabrics such as velvety), with a better image sharpness stamped by digital printing or sublimation, which had not been done before, also providing smoothing.

Fabric Cut (119)

This step consists in making a manual cut of each one of the pieces to the desired size.

Fused Cut (120)

This process consists of splicing the 3 faces or components that a quilt has, Face A, Wadding (Filled), Face B Confection (121)

This process consists of making the different sewing finishes through a sewing machine.

Figure 2:
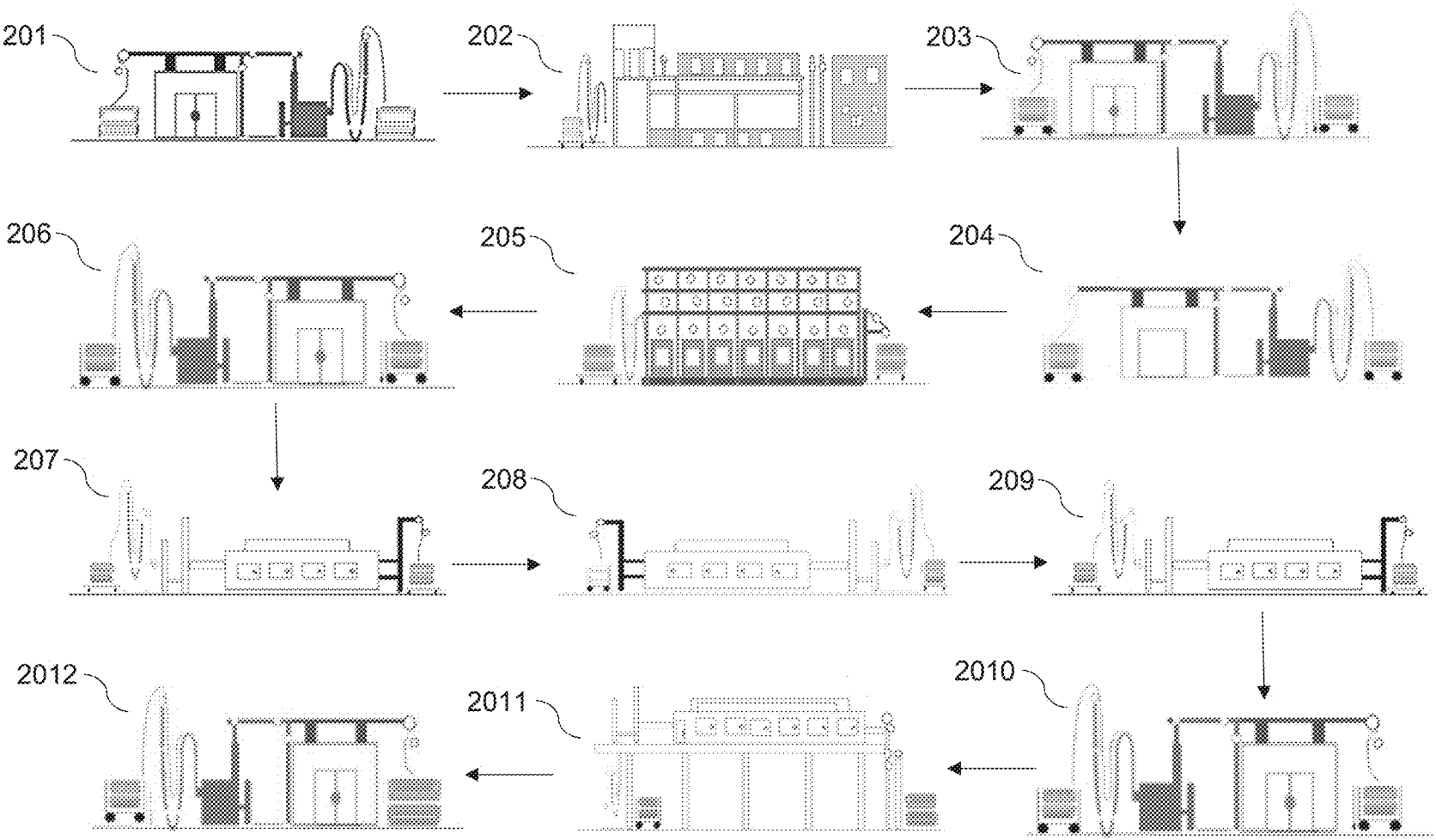
FIG. 2 shows a diagram of the system to improve the sharpness and stability of prints by digital printing on hair fabrics.
Figure 3A:
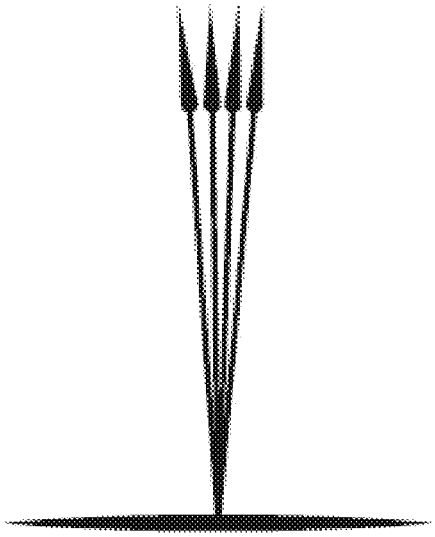
FIGS. 3*a* and 3*b* show a representative image of a hair of a fabric, where 3*a* is obtained by conventional methods and 3*b* is obtained by the proposed method.
Figure 3B:
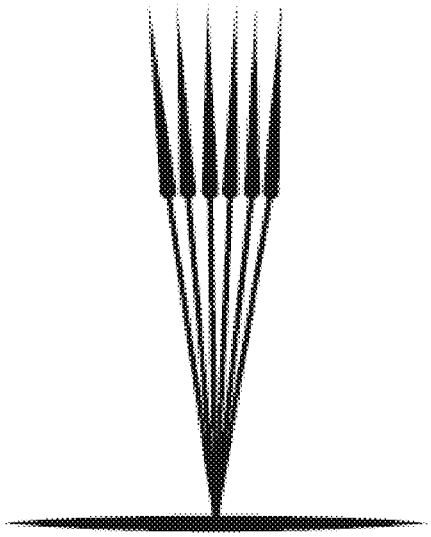

Still another object of the present invention refers to a system to improve the sharpness and stability of prints by digital printing on hair fabrics (FIG. 2), characterized in that it comprises:

A heat transmission device (201) for polishing a hair tissue by passing it through, which is configured to work at a temperature between 150 and 180° C. at a speed that allows an exposure time of between 10 and 26 m/min, preferably 15 m/min;

A digital printing module (202), specially designed for printing a scanned image, preferably by digital printing on the hair fabric;

A drying chamber (203) through which the hair fabric comprising a plurality of cooling and fluid dispersion means, preferably fans configured to work between 500 to 800 rpm and configured heat emission means, is passed to reach temperatures between 120 to 160° C., preferably at 155° C., where the fabric passes at a speed of between 4 to 25 m/min;

An airtight chamber (204) which contains a plurality of means for applying hot steam to the hair fabric at a temperature of at least 100° C., preferably at 110° C. for at least 5 min to heat set the colors;

A washing station (205) formed by a plurality of containers where the hair fabric is passed to remove the excess color;

A boiler (206) for drying the hair tissue;

A branch machine (207) to stretch the hair tissue and eliminate wrinkles;

A rip machine (208) specially designed to confer terry characteristics to the fabric by obtaining hair;

A shaver machine (209) to match the height of the fabric hair to the same length or remove the remaining fiber;

A second heat transmission device (2010) to polish the hair tissue by passing it through it for the second time configured to work at a temperature between 100 and 190° C. at a speed that allows an exposure time of between 5 and 20 m/min;

A branch machine (2011) through which the hair tissue is passed to heat set and avoid shrinkage and deformation;

A heat machine (2012) specially designed to apply a stream of hot air under pressure to a at a temperature of at least 180° C. at a speed of at least 2 m/min on the surface of the hair tissue to increase the diameter or volume of the hairs present.

Still a further aspect of the invention relates to a textile product obtained according to the method described above, which has a digitally printed patterned hair fabric, wherein said hair has greater color penetration in its fibers and a thickening in its circumference.

Although the above description was made taking into account the preferred embodiments of the invention, it should be taken into account by those skilled in the field, that any modification of form and detail will fall within the spirit and scope of the present invention. The terms in which this report has been written must always be taken in a broad and non-limiting sense. The materials, form and description of the elements, will be susceptible of variation as long as this does not imply an alteration of the essential characteristic of the model.

The invention claimed is:

1. A method to improve the sharpness and stability of prints by digital printing on hair fabrics, the method comprising the steps of:

a) polishing a hair fabric by passing the hair through a heat transfer device, at a temperature between 150 and 180° C. at a speed that allows an exposure time of between 10 and 26 m/min;

b) making a print of a digitized image, preferably by digital printing on the hair fabric;

c) passing the hair tissue through a drying chamber comprising the arrangement of cooling and fluid dispersion means, preferably fans configured to work between 500 to 800 rpm and heat emission means configured to reach temperatures between 120 to 160° C., where the fabric passes at a speed of between 4 to 25 m/min;

d) applying hot steam to the hair fabric within an airtight space at a temperature of at least 100° C. for at least 5 min to heat set the colors;

e) washing to remove excess color from hair tissue;

f) drying the hair tissue;

g) stretching the hair tissue to eliminate wrinkles;

h) performing a rip to confer terry characteristics to the tissue by obtaining hair;

i) shaving the hair in order to match the height of the hair to the same length, or remove the remaining fiber;

ii) polishing the hair fabric for the second time by passing it through a heat transfer device, at a temperature between 100 and 190° C. at a speed that allows an exposure time of between 5 and 20 m/min;

k) drying the hair tissue by branch to heat set and avoid shrinkage and deformation;

l) applying a stream of hot air under pressure at a temperature of at least 180° C. at a speed of at least 2 m/min on the surface of the hair fabric to increase the diameter or volume of the hairs present.

2. The method for improving the sharpness and stability of prints by digital printing on hair fabrics according to claim 1, further comprising an optional step of contacting the hair fabric with a color penetrating agent, preferably water.

3. The method for improving the sharpness and stability of prints by digital printing on hair fabrics according to claim 1, wherein the printing is sublimed, where firstly a printing on paper of the bond type and extra cellulose of 18 to 85 grams in dimensions coinciding with those of the fabric in treatment, where through a calender that inside has oil at a temperature between 205 and 215° C. and rotating at a speed of 3.4 m/min transfers the heat present in the oil and captures the image on the tissue.

4. The method for improving the sharpness and stability of prints by digital printing on hair fabrics according to claim 1, wherein the cooling and fluid dispersion means and the heat emission means are configured to regulate the temperature in a drying chamber, which can regulate the temperature gradually.

5. The method for improving the sharpness and stability of prints by digital printing on hair fabrics according to claim 1, wherein washing after the printing process, there is a washing step, wherein the fabric is subjected to a wash to remove excess color or residual material that may be present in the stamping stage; During the washing step a formulation consisting of a reducing agent, preferably thiourea dioxide, caustic soda and a detergent, mixed with water in the following proportions, 5% thiourea dioxide, caustic soda 5% detergent 15% and 75% water is used wherein said mixture is applied at a temperature of at least 80 degrees Celsius and in this way the excess color is removed without affecting the fabric.

6. The method for improving the sharpness and stability of prints by digital printing on hair fabrics according to claim 1, wherein the drying is carried out in an electric boiler, where it transmits heat at a temperature between 120 and 140° C. displacing the hair tissue at a speed of 13 m/min.

7. The method for improving the sharpness and stability of prints by digital printing on hair fabrics according to claim 1, wherein the hair fabric is stretched at least 5% more by applying heat at a temperature between 175 and 190° C.

8. The method for improving the sharpness and stability of prints by digital printing on hair fabrics in accordance with claim 1, further including the steps of cutting and making to finish a textile hair product.

9. A system to improve the sharpness and stability of prints by digital printing on hair fabrics, the system comprising:

a) a heat transmission device for polishing a hair tissue by passing it through, which is configured to work at a temperature between 150 and 180° C. at a speed that allows an exposure time of between 10 and 26 m/min;

b) a digital printing module, specially designed to print a scanned image by digital printing on the hair fabric;

c) a drying chamber through which the hair fabric comprising a plurality of cooling and fluid dispersion devices such as fans configured to work between 500 to 800 rpm and heat emission means configured to pass through reach temperatures between 120 to 160° C., wherein the fabric passes at a speed of between 4 to 25 m/min;

d) an airtight chamber that contains a plurality of hot steam devices to the hair fabric at a temperature of at least 100° C. for at least 5 min to heat set the colors;

e) a washing station consisting of a plurality of containers where the hair fabric is passed to remove the excess color;

f) a boiler to dry the hair tissue;

g) a branch machine to stretch the hair tissue and eliminate wrinkles;

h) a rip machine specially designed to confer terry characteristics to the fabric by obtaining hair;

i) a shaver machine to match the height of the hair of the fabric to the same length or remove the remaining fiber;

j) a second heat transmission device to polish the hair tissue by passing it through it for the second time configured to work at a temperature between 100 and 190° C. at a speed that allows an exposure time of between 5 and 20 m/min;

k) a branch machine through which the hair fabric is passed to heat set and avoid shrinkage and deformation;

l) a heat machine specially designed to apply a stream of hot air under pressure at a temperature of at least 180° C. at a speed of at least 2 m/min on the surface of the hair fabric to increase the diameter or volume of the hairs present.

10. A textile product obtained according to claim 9, further including a digitally printed hair fabric, wherein said hair has greater color penetration in its fibers and an increase in its circumference.

11. The textile product according to claim 9, wherein the textile product is bedding into blankets, quilts, clothing, woven articles for personal use, or any manufactured from hair fabrics.

* * * * *